US006425326B1

(12) United States Patent
Dorenkamp et al.

(10) Patent No.: US 6,425,326 B1
(45) Date of Patent: Jul. 30, 2002

(54) INKING UNIT IN A PRINTING MACHINE

(75) Inventors: Felix Dorenkamp, Mühlhausen; Jens Knepper, Heidelberg, both of (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/495,796

(22) Filed: Feb. 1, 2000

(30) Foreign Application Priority Data

Feb. 1, 1999 (DE) ..... 299 01 697 U

(51) Int. Cl.[7] ..... B41F 31/00
(52) U.S. Cl. ..... 101/351.1; 101/352.01
(58) Field of Search ..... 101/327–329, 101/348, 349.1, 352.01, 352.02, 352.04, 352.05, 352.07, 352.09, 347

(56) References Cited

U.S. PATENT DOCUMENTS 3,538,849 A * 11/1970 Bohman ..... 101/352
3,691,956 A * 9/1972 James et al. ..... 101/247
3,869,983 A * 3/1975 Garber et al. ..... 101/137
4,214,527 A * 7/1980 Kamota ..... 101/247
4,882,991 A * 11/1989 Simeth ..... 101/350
5,040,458 A * 8/1991 Jiruse et al. ..... 101/216
5,101,723 A * 4/1992 Holl et al. ..... 101/148
5,388,514 A * 2/1995 Eltner ..... 101/352
5,678,485 A * 10/1997 Guaraldi ..... 101/247
5,699,737 A * 12/1997 Hummel et al. ..... 101/247
5,845,576 A * 12/1998 Junghans ..... 101/484
6,050,188 A * 4/2000 Bolza-Schunemann ..... 101/183

FOREIGN PATENT DOCUMENTS

DE 37 10 300 A1 1/1988
DE 42 30 090 C2 3/1994

* cited by examiner

*Primary Examiner*—Eugene Eickholt
(74) *Attorney, Agent, or Firm*—Laurence A. Greenberg; Werner H. Stemer; Ralph E. Locher

(57) ABSTRACT

An inking unit in a printing machine includes a throw-off device for throwing an ink applicator roller group off a printing form cylinder, the throw-off device including a rotatable roller throw-off cam contoured so that, in a first rotational position of the cam, all the ink applicator rollers are in contact with the form cylinder and, in a second rotational position of the cam, the ink applicator roller group is thrown off the form cylinder and at least one ink applicator roller is in contact with the form cylinder; and a printing machine, especially an offset printing machine, having at least one inking unit with the foregoing features.

9 Claims, 8 Drawing Sheets

INKING UNIT IN A PRINTING MACHINE

BACKGROUND OF THE INVENTION

Field of the Invention

The invention relates to an inking unit in a printing machine, more particularly, having a throw-off device for throwing an ink applicator roller group off a plate cylinder.

The published German Patent Document DE 37 103 00 A1 describes a switching device for inking unit rollers in printing machines, wherein, by actuating an operating cylinder, two intermediate rollers can be lifted off distributor cylinders, so that ink flow continues only via the two first applicator rollers. In this switching state of the inking unit, two strands or ribbons of ink are provided with the task of continuing to even out the ink applied by the two first applicator rollers. Although, in the aforenoted switching state, no ink flow takes place over the applicator rollers associated with the two strands or ribbons of ink, these applicator rollers and, consequently, all of the applicator rollers, are also thrown onto the plate cylinder. An applicator roller throw-off cam is pivotable as a result of the actuation of another operating cylinder, so that all the applicator rollers can be thrown off the plate cylinder.

A disadvantage of the aforedescribed switching device is that the inking unit reacts sluggishly to changes in the inking, because a predetermined volume of ink is always stored in the two strands or ribbons of ink used to even out the applied ink, and this volume only very slowly equalizes any corrections that are necessary and, as a result of this sluggishness, is the cause of paper wastage. In addition, the inking unit also requires a comparatively great amount of time for being set to the respective printing jobs.

The published German Patent Document DE 42 30 090 C2 describes an inking unit for printing machines that is operatable as a so-called short or anilox inking unit, in that the printing plate is inked only via a first ink applicator roller group, and a second ink applicator roll group is lifted off the plate cylinder by a throw-off device. With respect to this inking unit, Although the deficiencies associated with the switching device described hereinbefore in the published German Patent Document DE 37 103 00 A1 are no longer present in that of the published German Patent Document DE 42 30 090 C2, the latter does not describe any specific throw-off device that is suitable for lifting off or disengaging the second ink applicator roller group.

SUMMARY OF THE INVENTION

It is accordingly an object of the invention to provide an inking unit for printing machines that is operatable in a variable manner and, in particular, in the short or anilox inking unit mode of operation, and that has ink applicator rollers which can be thrown off a plate cylinder by a throw-off device having a relatively simple construction and being very reliable functionally.

With the foregoing and other objects in view, there is provided, in accordance with the invention, an inking unit in a printing machine, comprising a throw-off device for throwing an ink applicator roller group off a printing form cylinder, the throw-off device including a rotatable roller throw-off cam contoured so that, in a first rotational position of the cam, all the ink applicator rollers are in contact with the form cylinder and, in a second rotational position of the cam, the ink applicator roller group is thrown off the form cylinder and at least one ink applicator roller is in contact with the form cylinder.

In accordance with another feature of the invention, in the second rotational position of the cam, a first ink applicator roller group is thrown off the form cylinder, and a second ink applicator roller group is in contact with the form cylinder.

In accordance with a further feature of the invention, in the second rotational position of the cam, as viewed in a direction of rotation of the cylinder, a first ink applicator roller and a second ink applicator roller are in contact with the form cylinder.

In accordance with an added feature of the invention, in the second rotational position of the cam, as viewed in a direction of rotation of the cylinder, a third ink applicator roller and a fourth ink applicator roller of four ink applicator rollers are in contact with the form cylinder.

In accordance with an additional feature of the invention, in a third rotational position of the cam, all the ink applicator rollers are thrown off the form cylinder.

In accordance with yet another feature of the invention, in a fourth rotational position of the cam, as viewed in a direction of rotation of the cylinder, the first ink applicator roller and the second ink applicator roller are in contact with the form cylinder.

In accordance with yet a further feature of the invention, in the second rotational position of the cam, as viewed in a direction of rotation of the cylinder, the first ink applicator roller is in contact with the form cylinder and the second, and a third and a fourth ink applicator roller are thrown off the form cylinder.

In accordance with yet an added feature of the invention, the inking unit includes two operating cylinders to which pressurized fluid is applicable for rotating the roller throw-off cam into rotational positions of the cam.

In accordance with yet an additional feature of the invention, the operating cylinders are formed as one structural unit having a tandem cylinder.

In accordance with still another feature of the invention, the roller throw-off cam has two guide tracks disposed side by side.

In accordance with still a further feature of the invention, the roller throw-off cam is rotatably mounted coaxially with the form cylinder.

In accordance with still an added feature of the invention, the roller throw-off cam is revolvingly rotatable and driven.

In accordance with still an additional feature of the invention, the roller throw-off cam is contoured approximately as shown in FIGS. 2 to 5, on the one hand, and FIGS. 7 to 13, on the other hand, respectively.

In accordance with a concomitant aspect of the invention, there is provided a printing machine, especially a rotatable offset printing machine, having at least one inking unit constructed with at least one of the foregoing features.

Thus, the inking unit according to the invention in a printing machine, having a throw-off device for throwing an ink applicator roller group off a form or plate cylinder, is distinguished by the fact that the throw-off device is a rotatable roller throw-off cam that is contoured so that, in a first rotational position of the cam, all the ink applicator rollers are in contact with the form or plate cylinder and, in a second rotational position of the cam, the ink applicator roller group is thrown off the form or plate cylinder, and at least one ink applicator roller is in contact with the form or plate cylinder.

There are offset printing machines in which the inking unit and a dampening unit can be coupled to one another via a connecting roller, and a dampening solution applicator roller applies an ink/dampening solution mixture to the form or plate cylinder when they are coupled. Such a dampening solution applicator roller is not an ink applicator roller in the sense of the invention. Instead, according to the invention, ink applicator rollers are understood to be those applicator rollers which primarily apply printing ink to the form or plate cylinder.

An advantageous feature of the inking unit according to the invention is that the ink applicator rollers are forcibly controlled by the roller throw-off cam, the ink applicator rollers being located in the respectively required position relative to one another, in each of the rotational positions of the cam, and malfunctioning being virtually impossible. A further advantage is to be seen in the low constructional outlay for the inking unit, which has been achieved as a result of the fact that all the ink applicator rollers have a common roller throw-off cam assigned thereto.

When the roller throw-off cam is in the first rotational position of the cam, both the at least one ink applicator roller and the ink applicator roller group are jointly in contact with the form or plate cylinder in order to ink the cylinder. This corresponds to the normal inking unit mode of operation of the inking unit. The inking unit can be operated as a short or anilox inking unit when the roller throw-off cam is in the second rotational position of the cam, and the form or plate cylinder is inked only by the at least one ink applicator roller.

A first embodiment developing the inking unit according to the invention advantageously is distinguished by the fact that the inking unit comprises at least four ink applicator rollers and, in the short or anilox inking unit mode of operation, corresponding to the second rotational position of the cam, at least two ink applicator rollers are in contact with the form or plate cylinder in order to ink the cylinder.

The invention, however, also includes inking units with altogether only three ink applicator rollers, wherein, in the short or anilox inking unit mode of operation, one ink applicator roller or two ink applicator rollers are in contact with the form or plate cylinder.

A second embodiment for developing the invention or the first embodiment thereof is distinguished by the fact that, in the second rotational position of the cam, as viewed in the direction of rotation of the cylinder, the last and the penultimate ink applicator rollers are thrown off the plate cylinder.

In an inking unit having a total of four serially-arranged ink applicator rollers, the last ink applicator roller corresponds to the fourth ink applicator roller, and the penultimate ink applicator roller corresponds to the third ink applicator roller. In an inking unit having a total of three ink applicator rollers, the last ink applicator roll corresponds to the third ink applicator roller and the penultimate ink applicator roll corresponds to the second ink applicator roller.

The designations of the ink applicator rollers as first, second, third and fourth ink applicator rollers used herein refer to the direction of rotation of the cylinder. Accordingly, the first ink applicator roller is that ink applicator roller which, in the normal inking unit mode of operation, initially inks a specific circumferential printing image point on the form or plate cylinder during each revolution of the cylinder as the first of all the ink applicator rollers and which, for example, is arranged immediately downline, as viewed in the direction of rotation of the cylinder, of a dampening solution applicator roller that dampens the cylinder during the process. Accordingly, the last ink applicator roller is that ink applicator roller which inks the printing image point as the last ink applicator roller before the printing image is transferred from the form or plate cylinder to the printing material or, in an offset printing unit, to a blanket cylinder.

A third embodiment for developing the invention, or for developing the first or second embodiment, is distinguished by the fact that in the second rotational position of the cam, the first ink applicator roller and the second ink applicator roller are thrown off the form or plate cylinder.

In the third embodiment, the second rotational position of the cam is not used to implement the short or anilox inking unit mode of operation, but the first stage of throwing off the four ink applicator rollers from the form or plate cylinder in two stages and, respectively, in pairs.

A further embodiment is distinguished by the fact that a third rotational position of the cam corresponds to a "printing off" position, i.e., a position wherein all the ink applicator rollers are located at a spaced distance from the plate cylinder.

In a development of a second embodiment according to the foregoing further embodiment, it is possible, for example, as a result of the rotation of the roller throw-off cam from the second rotational position of the cam into the third rotational position of the cam, for the first ink applicator roller and the second ink applicator roller to be lifted off the form or plate cylinder. In a development of a third embodiment according to the foregoing further embodiment, it is possible, as a result of the rotation of the roller throw-off cam from the second rotational position of the cam into the third rotational position of the cam, for the third applicator roller and the fourth ink applicator roller to lifted off the form or plate cylinder.

A further embodiment is distinguished by the fact that a fourth rotational position of the cam corresponds to a first stage of throwing the four ink applicator rollers onto the form or plate cylinder in stages, the ink applicator rollers, respectively, being thrown onto the form or plate cylinder in pairs.

In the second embodiment, wherein the second rotational position of the cam serves to implement a first throw-off stage of the ink applicator rollers, the fourth rotational position of the cam can serve to implement the short or anilox inking unit mode of operation.

A further embodiment is distinguished by the fact that, in an inking unit having a total of four ink applicator rollers, in the second rotational position of the cam, only the first ink applicator roller is in contact with the form or plate cylinder.

In this way, a short or anilox inking unit mode of operation can be implemented with only a single ink applicator roller inking the form or plate cylinder in this mode of operation. The second, third and fourth ink applicator rollers can be lifted off the form or plate cylinder as a group of three due to the adjustment of the roller throw-off cam from the first rotational position of the cam into the second rotational position of the cam. As a result of the rotation of the roller throw-off cam from the second rotational position of the cam into the third rotational position of the cam, the first ink applicator roller can also be lifted off the form or plate cylinder, following the group of three, so that all the ink applicator rollers are out of contact with the form or plate cylinder.

A further embodiment is distinguished by the fact that the roller throw-off cam can be adjusted into the rotational positions of the cam by two piston/cylinder units which can be acted upon pneumatically or hydraulically.

The two piston/cylinder units are couplable to one another in such a way that the roller throw-off cam can be adjusted sequentially, in three setting steps, from the first into the second, from the second into the third and from the third into the fourth rotational position of the cam. A first unit of the piston/cylinder units includes a first cylinder housing and a first piston which is displaceable in the housing. A second unit of the piston/cylinder units includes a second cylinder housing and a second piston displaceable in the second housing. For example, the piston/cylinder units are couplable to one another by having the first piston and the second piston permanently or firmly connected to one another, and by permitting the cylinder housings to be moved independently of one another in relation to the connected pistons by the internal application of pressure. In an alternative coupling variation, the first piston can be permanently or firmly connected to the second cylinder housing, the first cylinder housing and the second piston being capable of being moved independently of one another in relation to the connected parts by the application of pressure. It is preferable, according to a further alternative coupling variant, for the first cylinder housing and the second cylinder housing to be permanently connected to one another, so that when pressure is applied, the first piston and the second piston are able to be moved independently of one another in relation to the connected cylinder housings. In all the three varying embodiments of the coupling which are described, the piston/cylinder units are preferably arranged in series so that they align in the axial direction thereof.

A further embodiment is distinguished by the fact that a tandem cylinder to which pressurized fluid can be applied in stages is constructed as a cam setting drive.

The tandem cylinder corresponds to a modification of the third-mentioned coupling variant, the two piston/cylinder units forming one structural unit with two expansion chambers separated from one another. One of the pistons is mounted so that it is displaceable in each of the expansion chambers, it being possible for the pistons to be extended from the structural unit in opposite directions by applying pressure to the two expansion chambers. The tandem cylinder is a particularly space-saving cam setting drive, which can be installed in the smallest space between other machine parts.

A further embodiment is distinguished by the fact that the roller throw-off cam, as viewed in the axial direction thereof, has two cam planes which are located one behind another and are contoured differently from one another.

Each of the cam planes can be formed, for example, by a cam disk having at least one circumferential lifting cam for lifting the inking rollers. The cam disks can be firmly or permanently connected to one another, for example, by being screwed together. The two cam disks can intrinsically be constructed identically, the different cam contour in the axial direction of the cam disks resulting from the fact that the cam disks are connected to one another in a position wherein they are rotated in the circumferential direction in relation to one another, for example, through 180°. A solid construction of the roller throw-off cam having the two cam planes, for example in a casting process with subsequent machining to remove material, is also possible. A first one of the cam planes can then serve to throw a first ink applicator roller or a first ink applicator roller group on and off, and a second of the cam planes can serve to throw a second ink applicator roller or a second ink applicator roller group on and off.

A further embodiment is distinguished by the fact that an axis of rotation of the cam extends coaxially with the axis of the form or plate cylinder.

The scope of the invention, however, also includes inking units wherein the roller throw-off cam is rotatably mounted so as to be offset eccentrically with respect to the axis of rotation of the form or plate cylinder, and has a cam axis of rotation extending parallel to the axis of rotation of the form or plate cylinder.

A further embodiment is distinguished by the fact that the roller throw-off cam is rotatable through more than 3600 about the axis of rotation thereof and, in the process, can be set into the corresponding rotational positions of the cam.

By rotating the roller throw-off cam exclusively in a single direction of rotation, for example, in the clockwise direction, the roller throw-off cam can be rotated in successive setting steps from an initial position, which can, for example, correspond to the first rotational position of the cam, into an end position, which for example can correspond to the fourth rotational position of the cam, and by being rotated farther while maintaining the direction of rotation, can be rotated out of the end position and into the initial position again. In this way, the roller throw-off cam can be rotated from the first into the second, from the second into the third, from the third into the fourth and from the fourth into the first rotational position of the cam again in the aforementioned sequence.

The inking unit is particularly suitable for a rotary printing machine which, for example, can be constructed as an offset printing machine.

Other features which are considered as characteristic for the invention are set forth in the appended claims.

Although the invention is illustrated and described herein as embodied in an inking unit in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
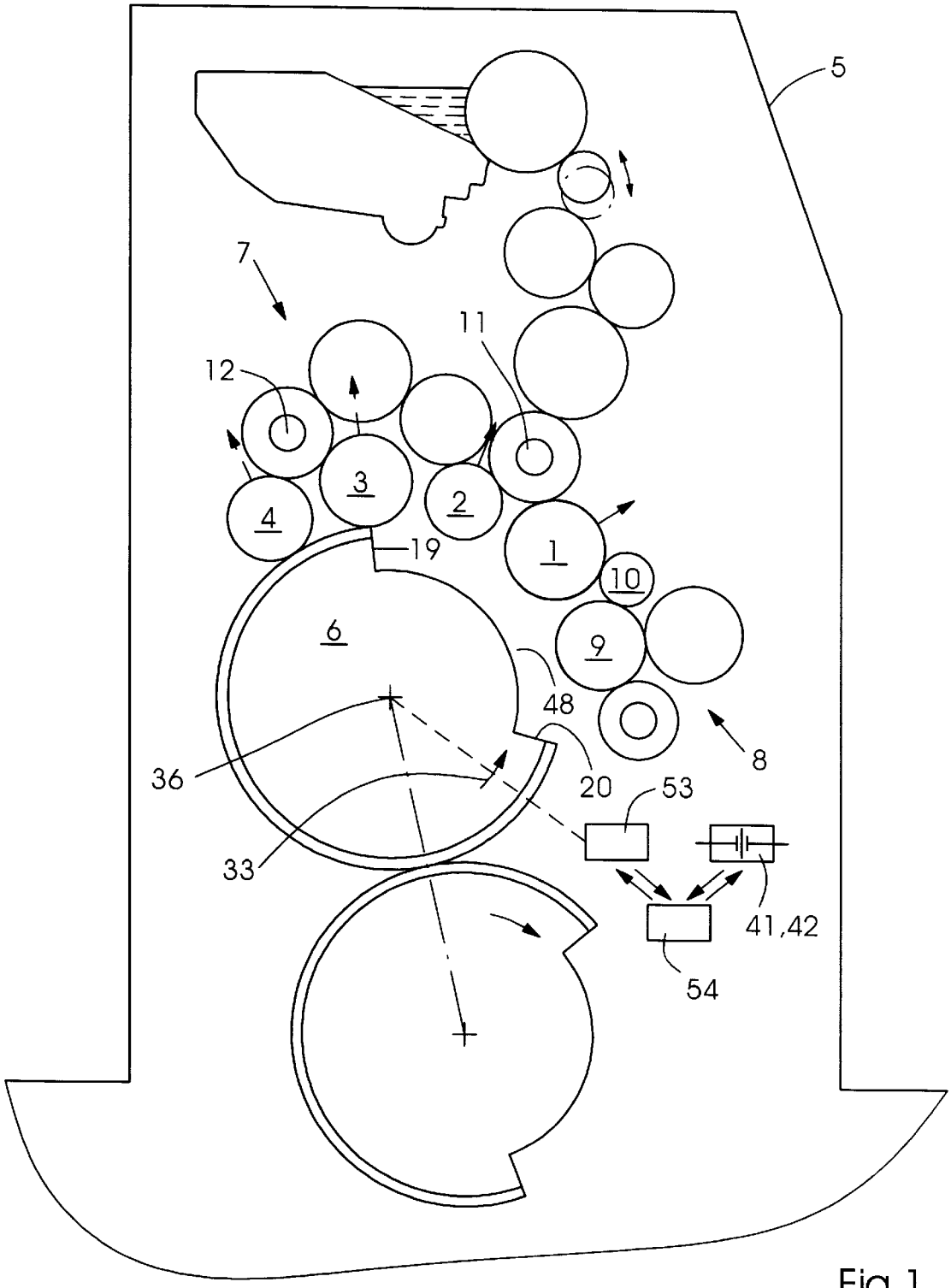
FIG. 1 is a diagrammatic and schematic side elevational view of a printing machine having an inking unit including four ink applicator rollers and constructed in accordance with a first or second exemplary embodiment of the invention for inking a printing form or plate cylinder.

Referring now to the drawings and, first, particularly to FIG. 1 thereof, there is shown therein a printing machine 5 in the form of a rotary offset printing machine wherein printing ink is fed from a wedge-shaped ink fountain, via a roller train of an inking unit 7, to a form cylinder such as a plate cylinder 6, and is applied by a number of ink applicator rollers 1 to 4 to a printing form, such as a printing plate, that is clamped on the form or plate cylinder 6. From the form cylinder 6, the printing ink is transferred to a blanket cylinder of like diameter, that is in rolling contact with the form cylinder 6, and from the blanket cylinder to suitable printing material. A dampening unit 8 includes a dampening-solution applicator roller 9 for applying dampening solution to the printing form or plate, and is couplable with the inking unit 7 via a connecting roller 10. When the dampening unit 8 is being operated coupled to the inking unit 7, the connecting roller 10 is in contact with both the dampening-solution applicator roller 9 and the first ink applicator roll 1, and when the dampening unit is in decoupled operation, the contact between the connecting roller 10 and at least one of the rollers 1 and 9 is broken. In coupled operation, part of the dampening solution is led into the inking unit 7 via the intermediate roller 10, and the printing form is dampened indirectly by the ink applicator roller 1, which carries a printing ink/dampening solution emulsion which is predominantly composed of printing ink. The dampening-solution applicator roller 9, which serves for directly dampening the printing form during the coupled operation, also guides a dampening solution/printing ink emulsion in the coupled operation, and thus, to some extent, guides printing ink.

The ink applicator rollers 1 to 4, as viewed in the direction of rotation indicated by the arrow 33 of the cylinder 6, are arranged in succession and apply the printing ink one after another to the printing form or plate in a manner corresponding to the increasing sequence of reference numerals thereof, beginning with the ink applicator roller 1. A first inking unit roller 11 is in rolling contact both with the first ink applicator roller 1 and with the second ink applicator roller 2, and a second inking unit roller 12 is in rolling contact both with the third ink applicator roller 3 and the fourth ink applicator roller 4.

The first inking unit roller 11 is formlockingly rotationally driven via a transmission mechanism, and drives the ink applicator rollers 1 and 2 rotationally by a circumferential frictional connection. The second inking unit roller 12 is likewise formlockingly rotationally driven via a transmission mechanism, and drives the ink applicator rollers 3 and 4 rotationally by a circumferential frictional connection. In regard to the foregoing, it is noted that a formlocking connection is one which connects two elements together due to the shape of the elements themselves, as opposed to a forcelocking connection, which locks the elements together by force external to the elements, The first inking unit roller 11 is a first ink distributor roller 11 that is oscillatingly driven formlockingly or positively in the axial direction thereof, and the second inking unit roller 12 is a second ink distributor roller having an axial movement that is likewise driven via an oscillating transmission mechanism. The ink flow takes place from the first inking unit roller 11 directly onto the first ink applicator roller 1 and directly onto the second ink applicator roller 2, and from the latter indirectly, via two non-identified transfer rollers, to the second inking unit roller 12 and from the latter directly onto the third ink applicator roller 3 and directly onto the fourth ink applicator roller 4.

The form or plate cylinder 6 is rotatingly driven via a transmission mechanism by a cylinder rotary drive 53 constructed as an electric motor. The plate cylinder 6 is formed with a cylinder gap or channel 48 extending in the axial direction over the entire axial length of the cylinder 6 and, in the circumferential direction, from a leading channel end 19 as far as a trailing channel end 20, and is open to the outside like a groove. An electronic control device 54 is linked controllingly with the cylinder rotary drive 53 and a cam rotary drive 41, 42 or 67, which is described in greater detail hereinafter, so that each of the ink applicator rollers 1 to 4 can be thrown off the plate cylinder 6 exactly at the point at which the cylinder channel or gap 48 is located opposite the respective ink applicator roller 1 to 4 which is to be thrown off. The respective ink applicator rollers 1 to 4 are lifted off the plate cylinder 6 in accordance with the cylinder phase angle and in groups by appropriate activation of the cam rotary drive 41, 42 or 67 by the control device 54.

In the embodiment shown in FIG. 1, initially, the first ink applicator roller 1 together with the second ink applicator roller 2 and, sequentially following this pair of rollers 1 and 2, the third applicator roller 3 pairwise with the fourth ink applicator roller 4 are lifted off the form or plate cylinder 6 after one another during a single revolution of the latter.

In a non-illustrated modified embodiment, initially, the first ink applicator roller 1 and, thereafter, an ink applicator roller group 2 to 4 formed of the three ink applicator rollers 2 to 4 are lifted off the form or plate cylinder 6 during a single cylinder revolution.

Throwing the ink applicator rollers 1 to 4 on and off in the cylinder channel or gap 48, precisely at the moment the cylinder channel or gap 48 is turning by underneath the respective ink applicator rollers 1 to 4 is advantageous because each ink applicator roller 1 to 4 to be thrown off is thus reliably out of contact with the printing form or plate, and a formation of stripes on the printing form or plate is thereby prevented. So-called lift-off stripes can be caused by the ink applicator roller to be lifted off, in particular in the case of a very tacky printing ink, when the ink applicator roller also tears off therewith part of the film of printing ink already rolled onto the printing form or plate, due to the development of an adhesive effect between the printing ink and the ink applicator roller to be thrown off. By throwing the ink applicator rollers 1 to 4 on and off in the cylinder channel or gap 48, as described hereinbefore, not only are such lift-off stripes but also so-called undesirable set-down stripes reliably avoided, which might occur due to an abrupt placement of the respective ink applicator roller onto the printing form or plate, and a possibly resulting squeezing away of the film of printing ink located on the printing form or plate along a contact line between the ink applicator roller to be thrown on and the printing form or plate.

In specific non-illustrated applications, it is also possible to throw all the ink applicator rollers 1 to 4 simultaneously off the plate cylinder 6, if the cylinder gap or channel 48 is located opposite all the ink applicator rollers 1 to 4.

Throwing the ink applicator rollers 1 to 4 on and off in groups takes particular account of the circumstance that each roller setting or adjusting device, and also the roller throw-off device and roller throw-on device comprising the cam rotary drive 41, 42 or 67 and the roller throw-off cam 17, 18 or 70, are subject to a given switching inertia that is specific to the system. It is advantageous that the time window, that increasingly decreases with increasing printing speed and rotational speed of the plate cylinder 6, respectively, and within which a switching of the rollers is possible, is significantly greater in the case of the illustrated switching of the ink applicator rollers 1 to 4 performed in sequence as shown and, for example, in pairs, than in the case of a switching of all of the four ink applicator rollers 1 to 4 which just fit into the cylinder channel or gap 48.

In FIG. 1, continuous arrows are used to illustrate how the first ink applicator roller 1 is lifted off or away from the cylinder gap or channel 48 simultaneously with the second ink applicator roller 2, while the cylinder channel or gap 48 is not yet located opposite the third ink applicator roller 3 and fourth ink applicator roller 4. As soon as the cylinder channel or gap 48 is located in a somewhat further-rotated position, and thus opposite the third ink applicator roller 3 and fourth ink applicator roller 4, the latter rollers 3 and 4 are thrown off simultaneously.

In the aforedescribed switching sequences, in many applications undesired rolling over the entire printing length of the printing form or plate again by those of the ink applicator rollers 1 to 4 which have remained in contact with the form or plate cylinder 6 after the initial switch-off stage, and those of the total number of provided rollers 1 to 4 which are to be thrown off the form or plate cylinder 6, in the second stage, are prevented, which provides an additional advantage of the invention.

An exactly reversed sequence of all of the aforedescribed switching variations of the ink applicator rollers 1 to 4 is likewise possible. For example, first of all, the ink applicator rollers 3 and 4 can be lifted off in pairs and, thereafter, the ink applicator rollers 1 and 2 can be lifted off in pairs. It is also possible initially to lift off the ink applicator rollers 2, 3 and 4 in groups, and thereafter to lift off the ink applicator roller 1 alone. The effect provided in the case of this reversed sequence, that the ink applicator roller group 1, 2 or ink applicator roller 1 which is thrown off last rolls over the printing form or plate again and is thrown off only after this rolling action in the cylinder gap or channel 48, does not have a disruptive effect upon the printing quality in many applications.

In order to convert the inking unit 7 from a normal inking unit mode of operation into a short or anilox inking unit mode of operation, the ink flow carried out from the ink fountain via the illustrated inking unit rollers to the third ink applicator roller 3 and the fourth ink applicator roller 4 may be interrupted by an interruption of the ink flow from the second ink applicator roller 2 to the second inking unit roller 12. This is effected by breaking the rolling contact between the second ink applicator roller 2 and the transfer roller in contact with the latter, so that a space is formed preventing ink flow between the second ink applicator roller 2 and the transfer roller.

Figure 2:
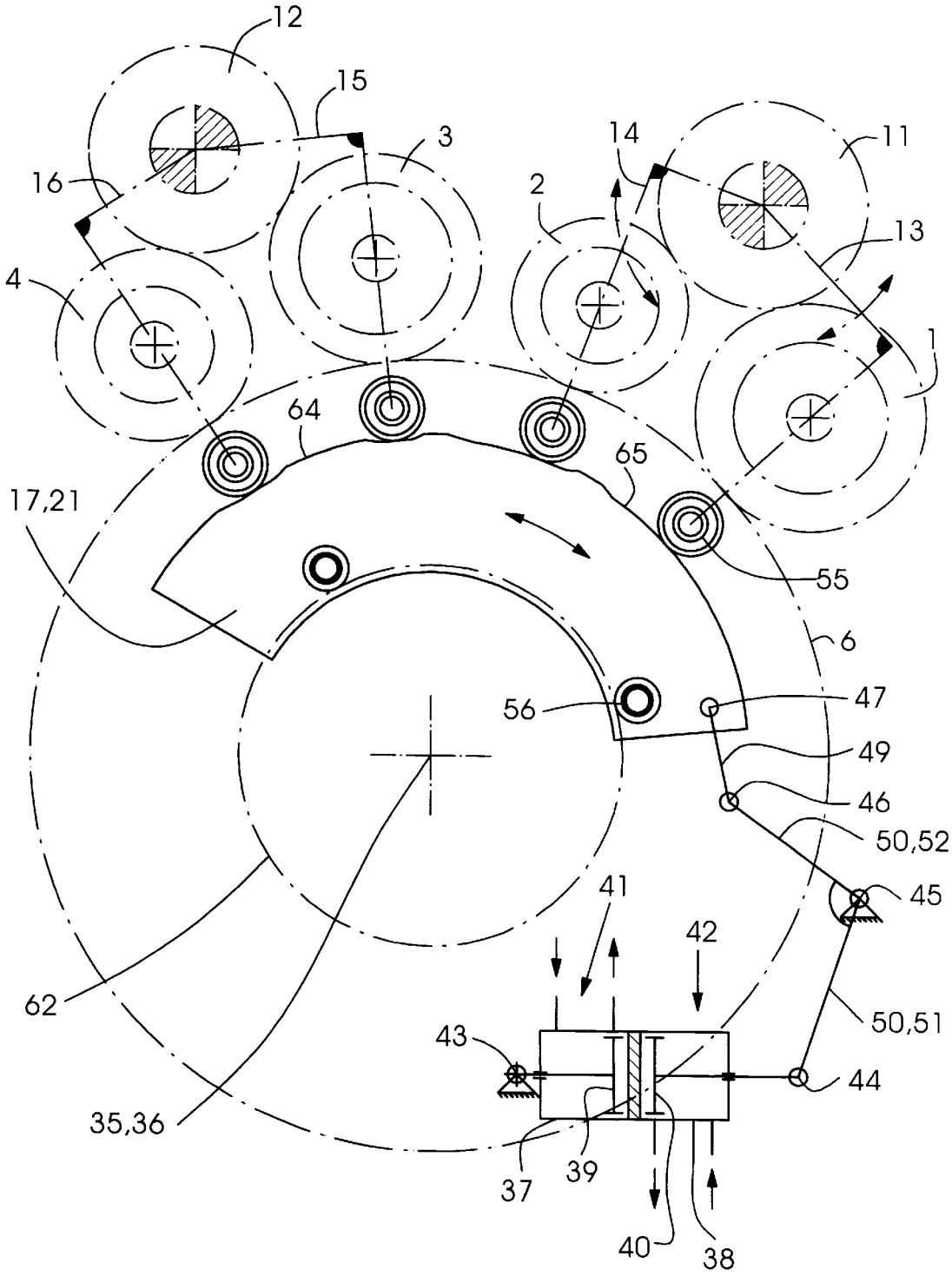
FIG. 2 is an enlarged fragmentary view of FIG. 1 showing the drive side of the inking unit constructed in accordance with the first exemplary embodiment, in a "normal inking unit" operating setting.

FIG. 2 illustrates part of an inking unit 7, the ink applicator rollers 1 to 4 of which being in a thrown-on position corresponding to the normal inking unit mode of operation. Corresponding to the viewing direction selected for FIG. 2, a roller throw-off cam 17 assigned to the plate cylinder 6 on the so-called drive side of the printing machine 5, and rollers 55 supported on the roller throw-off cam 17, are actually concealed by the form or plate cylinder 6 which is shown in phantom. This applies as well to the cam drive 41, 42 for adjusting the roller throw-off cam 17, and a transmission mechanism 44 to 52 for transmitting the adjusting movement of the cam drive 41, 42 to the roller throw-off cam 17. However, for reasons of improved clarity, the form or plate cylinder 6 and the rollers 1 to 4, 11 and 12 have not been shown in section, and instead the actually sectioned parts are illustrated in phantom or with dot-dash lines as being invisible in the view of the drawing.

The cam drive 41, 42 is constructed as a tandem cylinder 41, 42, wherein a first operating cylinder 41 and a second operating cylinder 42 are integrated in series or tandem, so as to form one structural unit. A first piston 39 and the piston rod thereof, respectively, are articulatedly connected, via a first frame-fixed rotary joint 43, to an otherwise unidentified printing machine frame, and is supported on the latter. The first piston 39 is disposed in a first cylinder housing 37, that is mounted on the piston 39 so that it can move translatorily. The first cylinder housing 37 is firmly or permanently connected to a second cylinder housing 38 which, for example, can be implemented in practice by a tube that is subdivided by a dividing wall or partition illustrated as a wide central line into the two cylinder housings 37 and 38. Mounted so as to be movable translatorily in the second cylinder housing 38 is a second piston 40, to which or to the piston rod of which a first lever arm 51 of a rocker 50 is articulatedly linked via a displaceable second rotary joint 44.

The rocker 50 is mounted in a frame-fixed third rotary joint 45. A second lever arm 52 of the rocker 50 is connected via a displaceable fourth rotary joint 46 to a coupling link 49, to which the roller throw-off cam 17 is articulatedly linked via a displaceable fifth rotary joint 47. By applying a pressurized fluid selectively and under the control of the electronic control device 54 (FIG. 1) to the annular piston surface of the first piston 39 having the piston rod, the piston 39 can be retracted, and by applying a pressurized fluid to the circular side of the first piston 39, facing the dividing wall or partition, the piston 39 can be extended, so that the operating cylinders 41, 42 can be displaced to the right or left due to the application of pressurized fluid to the first piston 39. By a comparable application of pressurized fluid to the second piston 40, that is constructed identically to and as a mirror image of the first piston 39, the piston 40 can likewise be extended and retracted. As a result of this ability to extend the pistons 39 and 40 in opposite directions, the remotely controllable cam drive 41, 42 forms a variable-length swinging drive of the coupling mechanism 51 to 52 which adjusts the roller throw-off cam 17 into the rotational positions 21 to 23 of the cam.

Each ink applicator roller 1 to 4 is rotatably mounted in a respective roller support lever 13 to 16, which is permanently supported on the cam contour 64, 65 of the roller throw-off cam 17 via a supporting roller that is likewise rotatably mounted in the respective roller support lever 13 to 16. The first roller support lever 13 and the second roller support lever 14 are mounted so that they can be pivoted independently of one another about the mid-axis of the first inking unit roller 11. The third roller support lever 15 and the fourth roller support lever 16 are likewise mounted so that they are pivotable independently of one another about the mid-axis of the second inking unit roller 12. The annular segment-like roller throw-off cam 17 is rotatable about a cam axis of rotation 35 coinciding with the axis of rotation 36 of the cylinder 6.

In FIG. 2, both operating cylinders 41 and 42 are in the retracted state, so that the roller throw-off cam 17 is kept in the first rotational position 21 of the cam 17, wherein all of the ink applicator rollers 1 to 4 are in contact with the plate cylinder 6. In this rotational position of the cam 17, all the roller support levers are supported, via the rollers 55 thereof or alternatively via a respective sliding or recoil-guide shoe, in set-back hollows or depressions 65 formed in the circumferential cam contour 64, 65.

Figure 3:
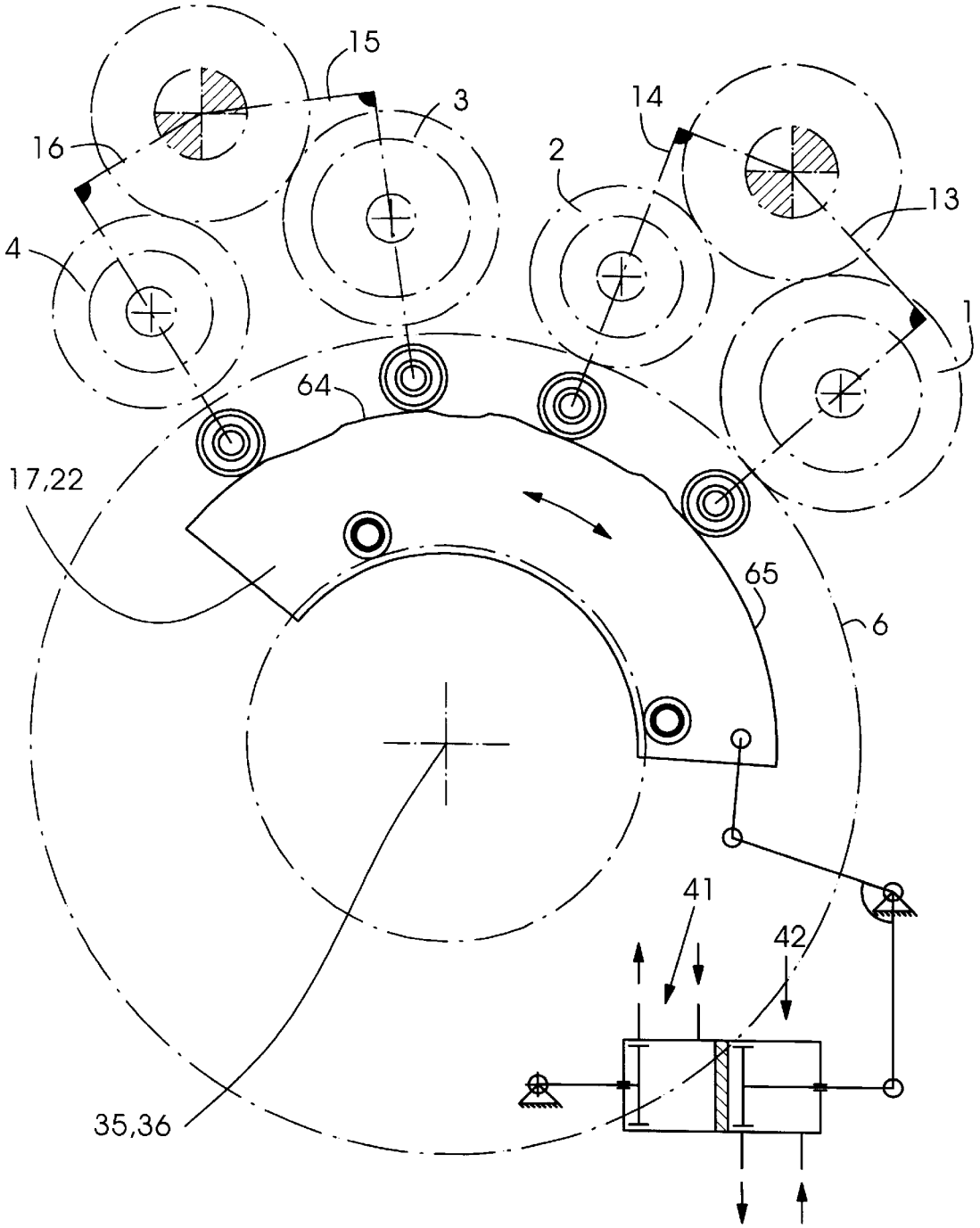
FIG. 3 is a view like that of FIG. 2 showing the inking unit in a "short inking unit" or an "anilox inking unit" operating setting.

FIG. 3 shows a second rotational position 22 of the roller throw-off cam 17 corresponding to the short or anilox inking unit mode of operation, the roller throw-off cam 17 in the position 22 being rotated a relatively short distance in the clockwise direction by comparison with the first rotational position 21 of the cam 17 shown in FIG. 2, so that both roller support levers 15 and 16 are held in a position forced away from the form or plate cylinder 6 by the projecting cams 64, respectively, and the ink applicator rollers 3 and 4 are thus spaced a distance from the form or plate cylinder 6. In the second rotational position 22 of the cam 17, the roller support levers 13 and 14 are supported in respective hollows 65 formed in the roller throw-off cam 17, so that the inking of the printing form or plate is performed exclusively via the first ink applicator roller 1 and the second ink applicator roller 2.

The recessed hollows 65, wherein the roller support levers 13 and 14 are supported in the second rotational position 22 of the cam, are the same as those wherein the roller support levers 13 and 14 are supported in the first rotational position 21 of the cam, and form an equidistant detent circle which is smaller than a large stop circle formed by the elevated cams 64, as referred to the axis of rotation 35 of the cam 17. Contouring the hollows 65 to have the shape of a circular arc ensures that when the ink applicator rollers 3 and 4 are lifted off, the ink applicator rollers 1 and 2 are kept permanently thrown-on with a constant pressure on the plate cylinder 6 by a corresponding rotation of the roller throw-off cam 17.

An aforedescribed switching position of the ink applicator rollers 1 to 4 in order to implement the short or anilox inking unit mode of operation differs from that shown in FIG. 3 only in the fact that, in addition, the second ink applicator roller 2 is also lifted off the plate cylinder 6 by a cam member on the roller throw-off cam 17, i.e., only the first ink applicator roller 1 is in contact with the plate cylinder 6, and does not need to be shown specifically.

The rotation of the roller throw-off cam 17 into the second rotational position 22 of the cam 17 is effected by one of the two operating cylinders 41 and 42 of the tandem cylinder 41, 42 already being extended by the appropriate application of pressurized fluid, while the other operating cylinder remains retracted. In the embodiment shown in FIG. 3, the first operating cylinder 41 has already been extended, and the second operating cylinder 42 is still retracted.

Figure 4:
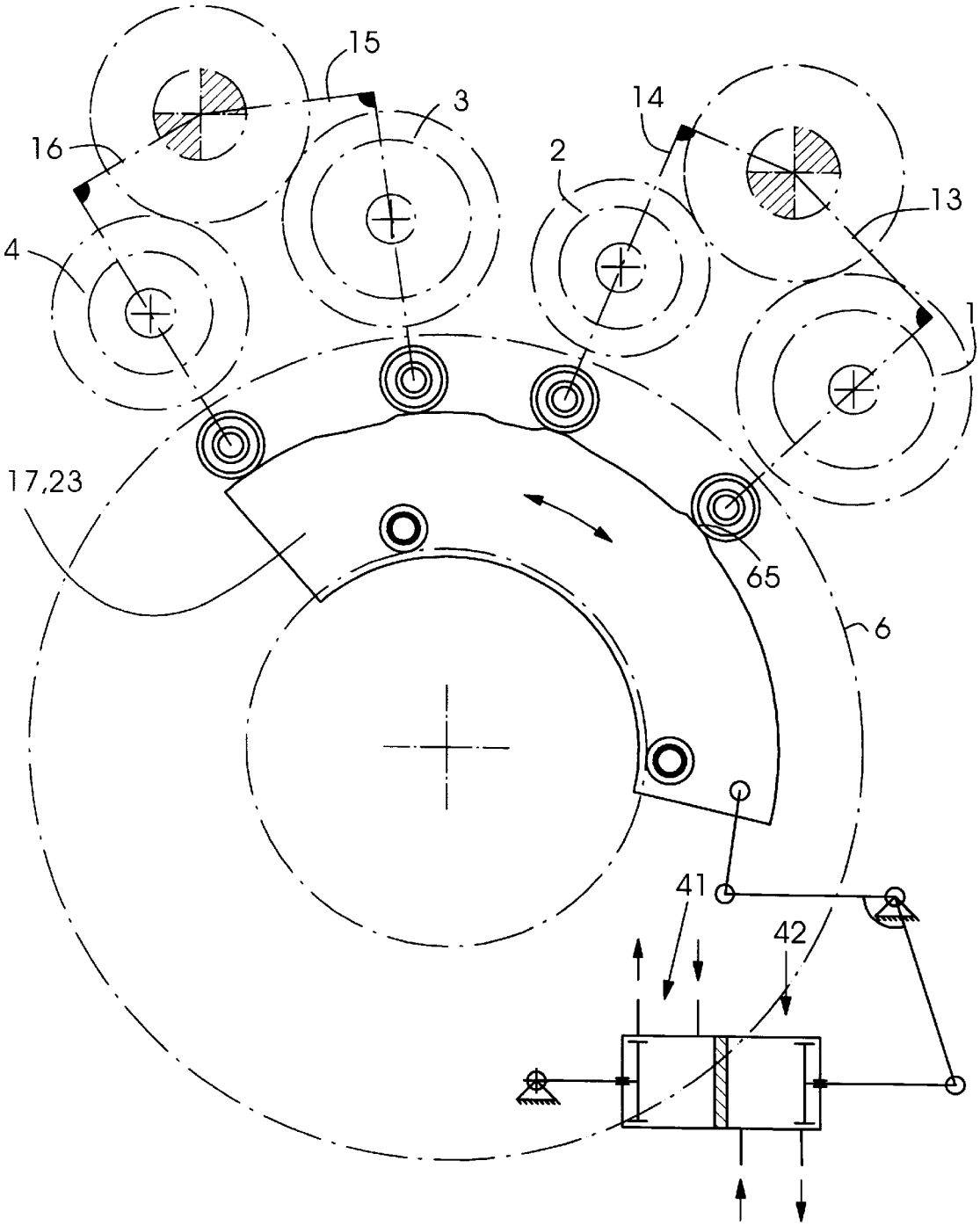
FIG. 4 is a view like that of FIG. 3 showing the inking unit in a "printing off" setting of the inking unit.

In the third rotational position 23 of the cam shown in FIG. 4, the roller throw-off cam 17 is rotated a slight distance farther in the clockwise direction by comparison with the second rotational position 22 of the cam shown in FIG. 3, so that then all the roller support levers 13 to 16, respectively, are supported on a projecting cam 64, and all the ink applicator rollers 1 to 4 are kept at a spaced distance from the circumferential surface of the plate cylinder 6 by the roller throw-off cam 17. This is effected by the extension of both operating cylinders 41 and 42. This switching position of the ink applicator rollers 1 to 4 corresponds to a "printing off" position, which is used both in the normal inking unit mode of operation and in the short or anilox inking unit mode of operation. In the normal inking unit mode of operation, in the event of any interruptions to printing and resumptions of the printing operation, the roller throw-off cam 17 is rotated from the first rotational position of the cam 17 (FIG. 2) into the third rotational position 23 of the cam 17, and back out of the latter position 23 again into the first rotational position 21 of the cam 17, the second rotational position 22 of the cam 17 (FIG. 3) being traversed each time. In the short or anilox inking unit mode of operation, a change is made only between the rotational positions 22 and 23 of the cam by reciprocatingly rotating the roller throw-off cam 17 suitably forward and back.

Figure 5:
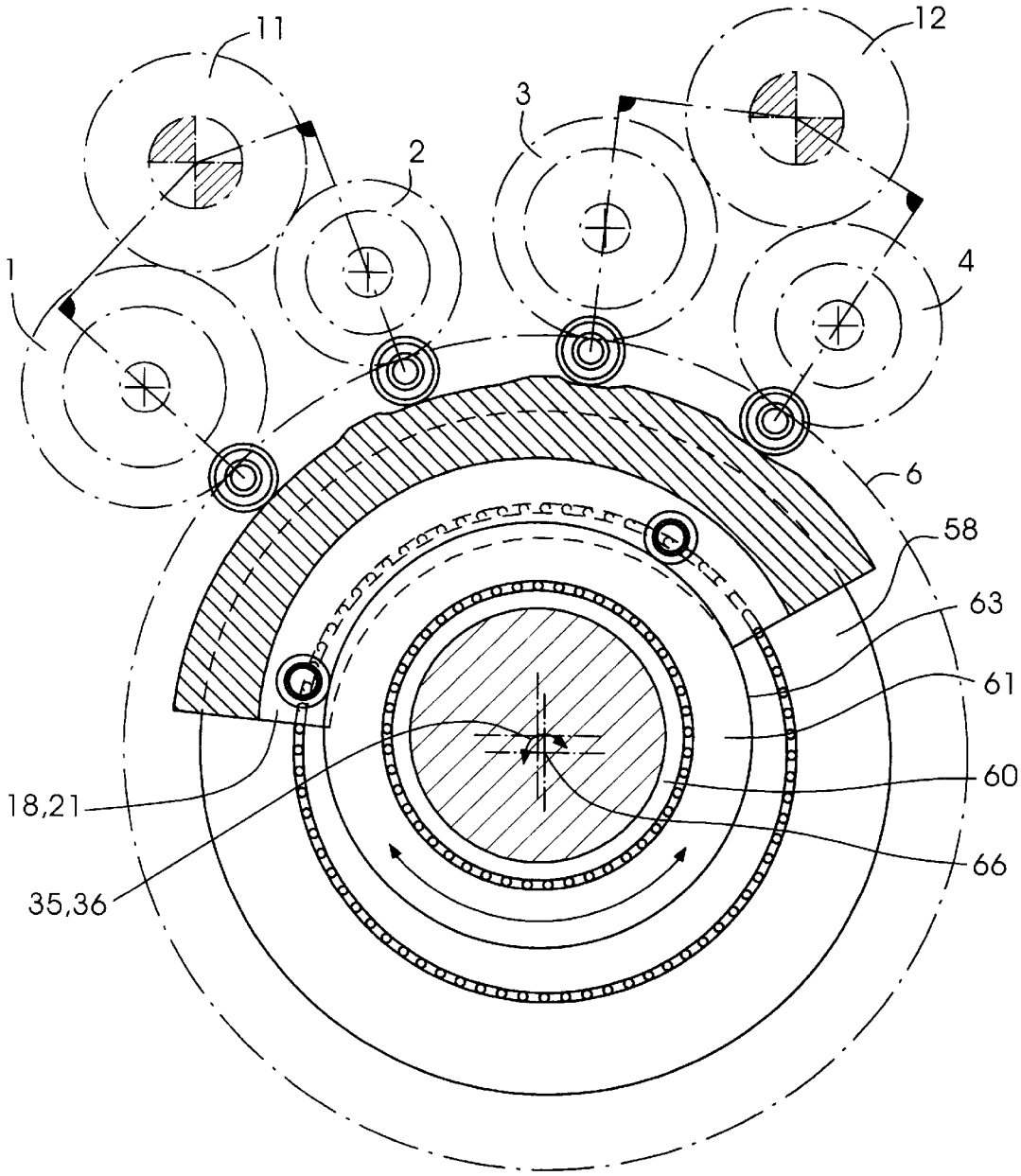
FIG. 5 is a view of the operating side of the inking unit shown on the drive side thereof in FIGS. 2 to 4.

FIG. 5 illustrates a further roller throw-off cam 18, that is assigned to the form or plate cylinder 6 on the so-called operating side of the printing machine 5 and is constructed in exactly the same manner as the roller throw-off cam 17 described initially and coupled to the latter, the roller throw-off cam 18 being rotated synchronously with the roller throw-off cam 17 by the cam rotary drive 41, 42. In FIG. 5, also, in the same manner as in FIG. 4, the rollers 1 to 4, 11 and 12 and the plate cylinder 6, which should actually be illustrated in section in this view, are in effect invisible by the fact that they have been illustrated in phantom by dot-dash lines, in the interest of clarity. The ink applicator rollers 1 to 4 are mounted on the operating side in roller support levers, which are constructed and arranged in exactly the same manner as the roller support levers 13 to 16 located on the drive side. In this way, the ink applicator rollers 1 to 4 are securely supported at both ends. The first rotational position 21 of the further roller throw-off cam 18, as shown in FIG. 5, corresponds to the first rotational position 21 of the roller throw-off cam 17, shown in FIG. 2.

Figure 6:
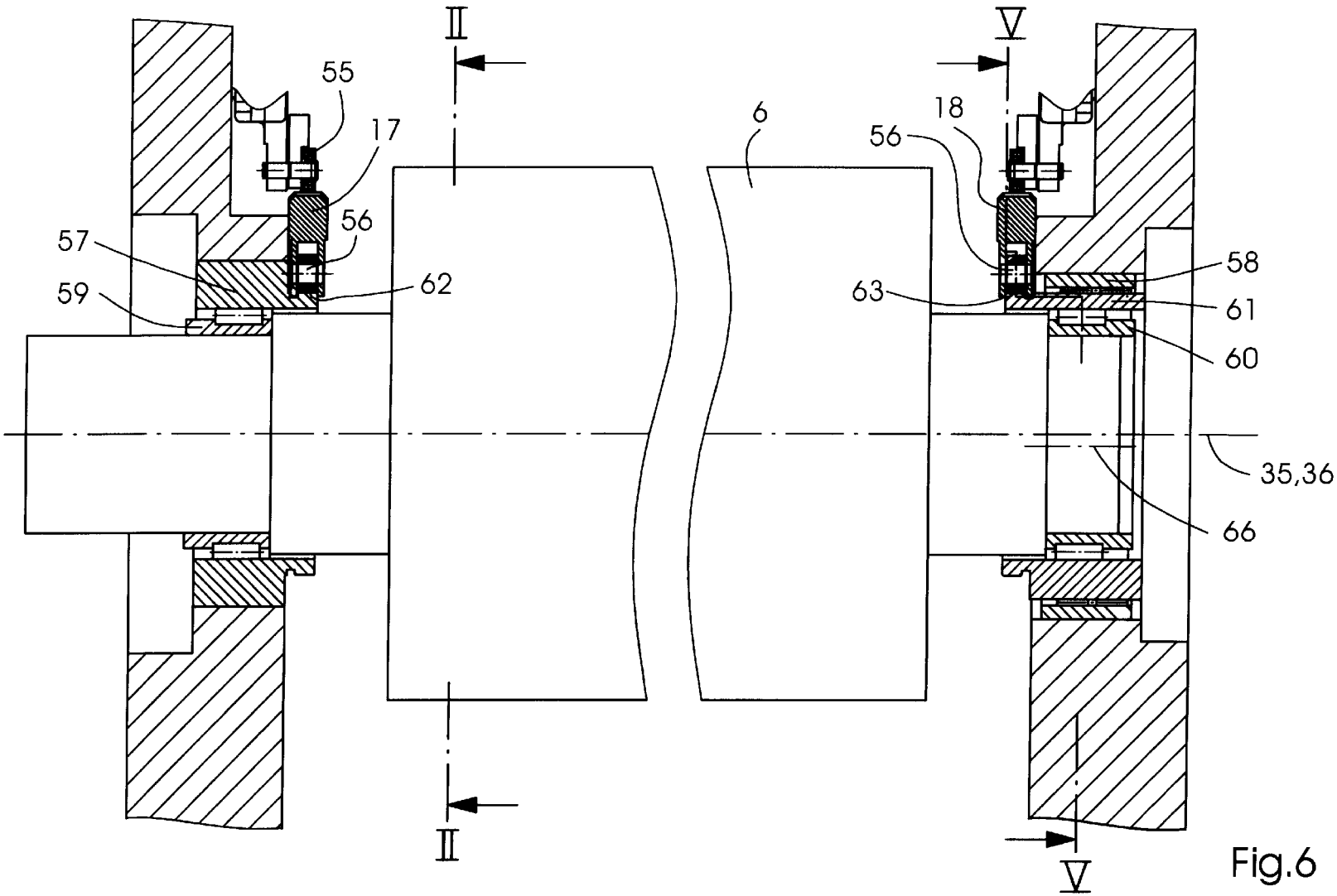
FIG. 6 is a longitudinal view, partly broken away and in section, of the printing form or plate cylinder mounted between two printing unit walls, showing a roller throw-off cam constructed as an annular segment and assigned to each end of the cylinder.

Furthermore, FIGS. 5 and 6 show that the plate cylinder 6 is rotatably mounted in a side wall on the operating side in a bearing including three rings 58, 60 and 61. An outer ring 58 is provided with a central bore and is mounted on a setting or adjusting ring 61 by rolling-contact elements. The setting ring 61 is provided with an eccentric bore and is likewise mounted on an inner ring 60 by rolling-contact elements. Furthermore, the setting ring 61 has an offset diameter 63, that is arranged coaxially with the eccentric bore of the setting ring 61. The roller throw-off cam 18 is rotatably mounted on the offset diameter 63 via bearing rollers in the rotational positions 21 to 23 of the cam 17. The inner ring 60 is provided with a central bore, into which a cylinder journal on the operating side of the form or plate cylinder 6 is inserted.

Rotation of the setting ring 61 causes the eccentric bore and offset diameter 63 thereof, and also the inner ring 60, to rotate about the center 66 of the outer ring 58. As a result, the plate cylinder 6 may be set obliquely in relation to the transport direction of the printing material, which is disposed in the plane of the drawing of FIG. 5 and perpendicular to the plane of the drawing of FIG. 6, and it is therefore possible for the so-called diagonal register of the plate cylinder 6 to be set or adjusted and corrected.

It is also apparent from FIG. 6 that the form or plate cylinder 6, on the drive side located on the lefthand side in FIG. 6, is rotatably mounted in the drive-side wall via a bearing including an outer ring 57 and an inner ring 59. The outer ring 57 and the inner ring 59 are provided with central bores, and the outer ring 57 is rotatably mounted on the inner ring 59 via rolling-contact elements. The outer ring 57 has an offset diameter 62, on which the roller throw-off cam 17, that is identical with the roller throw-off cam 18, runs rotatably on bearing rollers 56. The offset diameters 62 and 63 are enclosed by the respectively u-shaped and fork-like profiled roller throw-off cams 17 and 18, respectively, on both sides, so that the roller throw-off cams 17 and 18 are secured in the axial direction. The bores and therefore the centers of the rings 57 and 59 are disposed coaxially with the axes 35 and 36, and the offset diameter 62 is formed centrally and concentrically, respectively, with the bore of the outer ring 57. On the drive side, the mid-axis of the plate cylinder 6 is fixed in relation to the outer ring 57.

Due to the aforedescribed construction of the mountings on the operating and drive sides, the ink applicator rollers 1 to 4 are entrained or carried along during the setting or adjusting of a diagonal register, so that no changes to the pressure strips between the ink applicator rollers 1 to 4 and the plate cylinder 6 result, and the distance between the ink applicator rollers 1 to 4 and the plate cylinder 6 is not influenced during the oblique setting or adjusting movement.

A second exemplary embodiment is shown in FIGS. 7 to 13, and constitutes a modification of the first exemplary embodiment of the inking unit 7 shown in FIGS. 1 to 6. In the following description, therefore, it is necessary to discuss only the differences therein as compared with the previously described construction (FIGS. 1 to 6) of the inking unit 7. All the other features, such as the roller arrangement and the ink flow of the inking unit 7, the mounting and the supporting of the ink applicator rollers at both ends, and the aforedescribed possibility for setting the diagonal register may readily be transferred from the first to the second exemplary embodiment. For this reason, the reference numerals provided in FIGS. 1 to 6 may also be used for the same components in FIGS. 7 to 13. In order to explain the features shown in FIGS. 7 to 13 which differ from the construction in accordance with FIGS. 1 to 6, newly introduced reference numerals are used.

In the roller throw-off cam 70, the effective cam contour 68, 69 extends all around the circumference in closed form over a cam circumferential angle of 360°. The roller throw-off cam 70 has two cam planes which are offset in relation to one another in the axial direction thereof, a rear first plane being illustrated in FIG. 7, and a front second plane being illustrated in FIG. 8. For example, each of the planes can be produced as a separate cam disk, and these two cam disks can be permanently connected to one another in a coaxial position.

It is also possible for the roller throw-off cam 70 to be constructed as a compact part having the two planes, the planes being shaped, for example, by machining on the circumference thereof.

Figure 7:
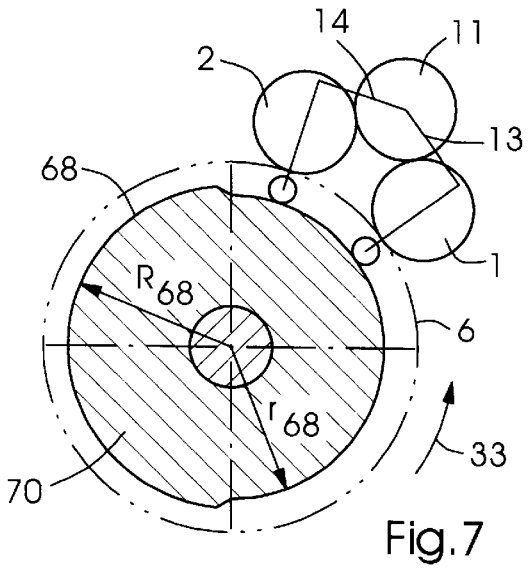
FIG. 7 is a cross-sectional view taken through a rearward-lying plane of a roller throw-off cam, formed as a revolving cam disk, of the inking unit, in accordance with the second exemplary embodiment of the invention.
Figure 8:
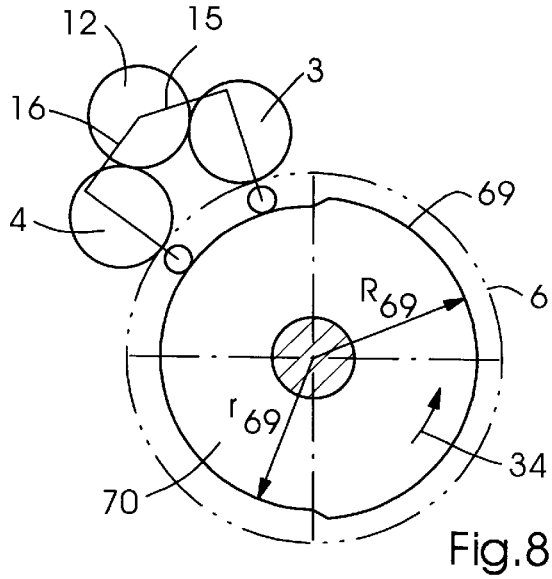
FIG. 8 is a front elevational view of the revolving cam disk of FIG. 7, shown in another operating phase thereof.

The first plane, illustrated in FIG. 7, has a circumferential first guide track 68, on which the roller support levers 13 and 14 of the first ink applicator roller 1 and of the second ink applicator roller 2 are supported. The third ink applicator roller 3 and the fourth ink applicator roller 4 have not been illustrated in FIG. 7, in the interest of clarity. The roller support levers 15 and 16 of the third ink applicator roller 3 and of the fourth ink applicator roller 4 are supported on the second guide track 69 of the second plane, illustrated in FIG. 8. The first guide track 68 therefore operates a first ink applicator roller pair 1 and 2, and the second guide track 69 operates a second ink applicator roller pair 3 and 4.

In alternative embodiments not otherwise shown in detail, the first ink applicator roller 1 can be operated by the first guide track 68 as a single ink applicator roller, the second guide track 69 serving for the groupwise operation of two or three ink applicator rollers arranged downline of the first ink applicator roller 1 in the direction of rotation of the cylinder 6. The purpose associated therewith, namely the implementation of the short or anilox inking unit mode of operation with only a single ink applicator roller, has already been explained in connection with FIGS. 1 to 6.

The first guide track 68 is subdivided into an elevated and a recessed stop or detent circle, the two stop circles extending over a circumferential angle of approximately 1800, and being connected to one another by short transition sections. The elevated stop or detent circle is determined by a radius $R_{68}$, which is greater than the radius $r_{68}$ determining the recessed stop or detent circle. The second guide track 69 is also formed of a semicircle having a large radius $R_{69}$ and a semicircle having a small radius $r_{69}$. Because the roller support levers 13 and 14 which can be operated by the first guide track 68 are generally dimensioned to have exactly the same length as the roller support levers 15 and 16 which can be operated by the second guide track 69, the radius $R_{68}$ can, in this case, correspond to the radius $R_{69}$, and the radius $r_{68}$ can correspond to the radius $r_{69}$. The first plane and the second plane are therefore contoured in mirror-symmetric fashion relative to a radial axis.

Five different rotational positions of the cam, and switching states "1" to "4" forcibly associated with these positions, respectively, are illustrated in FIG. 9 to FIG. 13. By a cam rotary drive 67, the roller throw-off cam 70 can be driven so as to revolve about the axis of rotation thereof, it being possible for the roller throw-off cam 70, as a result of being rotated in a single direction of rotation, for example, in the clockwise direction as shown, to be rotated sequentially, in a sequence corresponding to the increasing numbering of FIGS. 9 to 13, into the rotational positions of the cam shown in FIGS. 9 to 13, and consequently for the ink applicator rollers 1 to 4 to be switched into the switching states "1" to "4" corresponding to the rotational positions of the cam 70.

Figure 9:
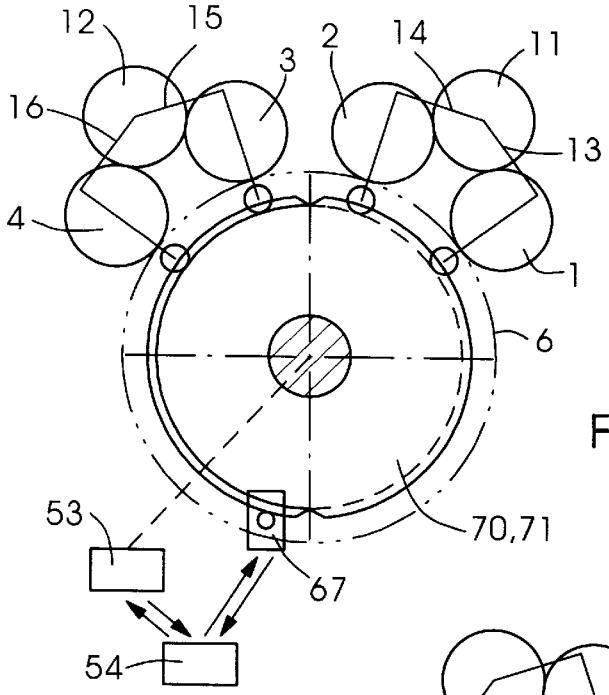
FIGS. 9 to 13 are further front elevational views of the revolving cam disk in different operating phases thereof wherein the revolving cam disk has assumed different rotational positions, respectively, and the ink applicator rollers corresponding to the respective rotational positions of the cam are in different switching positions.

In the rotational position of the cam 70 shown in FIG. 9, all the roller support levers 13 to 16 are supported on recessed cam contour regions or stop circles having small radii $r_{68}$, $r_{69}$. The switching state "1" corresponds to the normal inking unit mode of operation, wherein all the ink applicator rollers 1 to 4 are in contact with the form or plate cylinder 6.

Figure 10:
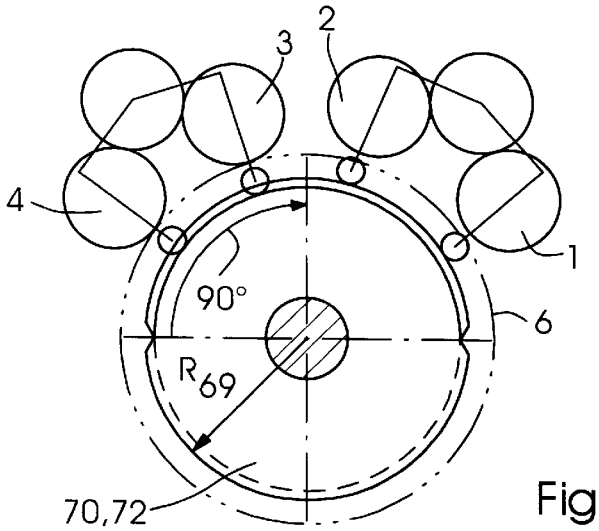

By rotation of the roller throw-off cam 70 through 90° into the rotational position 72 of the cam shown in FIG. 10, the first ink applicator roller 1 and the second ink applicator roller 2 are thrown off the form or plate cylinder 6, while the third ink applicator roller 3 and the fourth ink applicator roller 4 are not lifted. The switching state "2" shown in FIG. 10 corresponds to a first switch-off stage of the ink applicator rollers 1 to 4.

Figure 11:
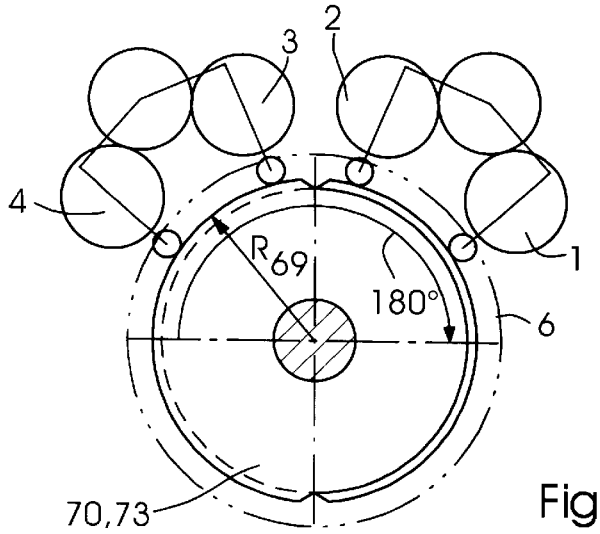

By rotating the roller throw-off cam 70 further through 90° into the rotational position 73 of the cam shown in FIG. 11, the third ink applicator roller 3 and the fourth ink applicator roller 4 are then thrown off the form or plate cylinder 6. The switching state "3" reached in this way corresponds to a "printing off" position of the ink applicator rollers 1 to 4.

The advantageous feature of the switching sequence shown in FIGS. 9 to 11 is that both the ink applicator rollers 1 and 2 can be lifted jointly in a cylinder gap or channel (not specifically illustrated here) and, following the ink applicator rollers 1 and 2, the ink applicator rollers 3 and 4 can also be lifted jointly into the cylinder gap or channel, so that when all the ink applicator rollers 1 to 4 are switched off, no part of the ink applicator rollers 1 to 4 rolls unnecessarily on the printing form or plate located on the form or plate cylinder 6.

It should be noted at this point that the terms employed in this description of the invention relating to throwing ink applicator rollers on and off "in pairs" "in groups" and "jointly" is intended to include the actions of throwing on and off both absolutely simultaneously and in groups immediately after one another. For example, as the roller throw-off cam 70 is rotated from the rotational position 72 of the cam into the rotational position 73 of the cam, the elevated cam region determined by the radius $R_{69}$ is initially slid underneath the roller support lever 16 and, as the roller throw-off cam 70 is rotated farther, is immediately subsequently slid under the roller support lever 15. The word "in groups" therefore means that two or more ink applicator rollers are lifted or thrown on from a first defined rotational position of the cam into a second defined rotational position of the cam as a result of a single rotation of the roller throw-off cam 70.

Of course, such a rapidly successive lifting of the ink applicator rollers of an ink applicator roller group which can be thrown on and off jointly is also possible in the exemplary embodiment shown in FIGS. 2 to 6. Going beyond this exemplary embodiment, the roller throw-off cams 17, 18 are contoured in such a way that, as they rotate, the ink applicator rollers 1 and 2 are also thrown on and off absolutely simultaneously, and the ink applicator rollers 3 and 4 are also thrown on and off absolutely simultaneously.

Figure 12:
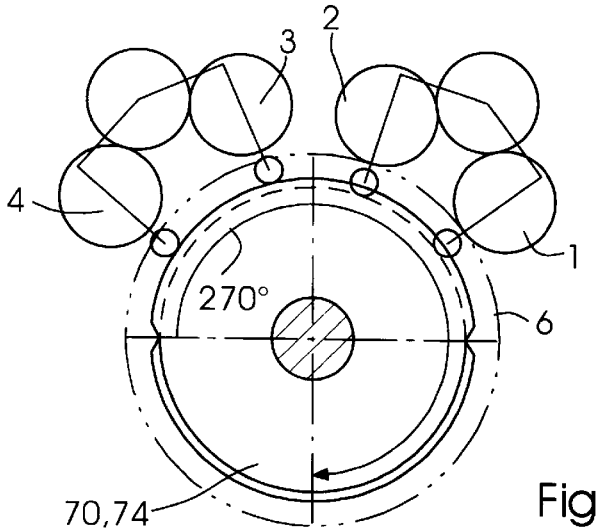

Starting from the rotational position 73 of the cam shown in FIG. 11, a next rotational step through a further 90° moves the roller throw-off cam 70 into the rotational position 74 of the cam shown in FIG. 12, and moves the inking unit rollers 1 to 4 into the switching state "4" shown, which corresponds to the short or anilox inking unit mode of operation. Of course, the roller throw-off cam 70 can be rotated back by the cam rotary drive 67 in the counterclockwise direction from this rotational position 74 of the cam, so that the ink applicator rollers 1 and 2 which are employed in the short or anilox inking unit mode of operation can be lifted off the plate cylinder 6, in the event of any interruptions to printing in this mode of operation, by adjusting the roller throw-off cam from the rotational position 74 of the cam into the rotational position 73 of the cam. By rotating the roller throw-off cam 70 from the rotational position 73 of the cam into the rotational position 74 of the cam again, printing operation can again be resumed in this case.

Figure 13:
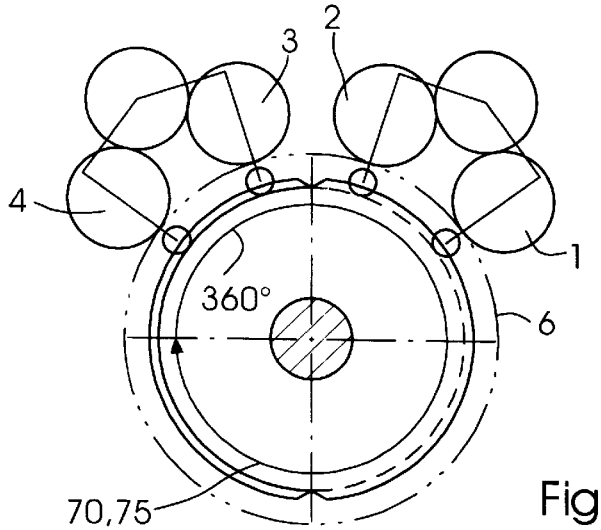

Rotating the roller throw-off cam 70 from the rotational position 74 of the cam into the rotational position 75 of the cam shown in FIG. 13 has the effect of throwing the ink applicator rollers 3 and 4 onto the form or plate cylinder 6. The switching state shown in FIG. 13 corresponds to the switching state "1" in FIG. 9, and the rotational position 75 of the cam corresponds to the rotational position 71 of the cam reached again following a complete revolution. In the normal inking unit mode of operation, "printing on" switching of the ink applicator rollers 1 to 4 is performed by rotating the roller throw-off cam 70 from the rotational position 73 of the cam, via the rotational position 74 of the cam corresponding to a first switch-on stage and also to the short or anilox inking unit mode of operation, into the rotational position 75 and 71, respectively, of the cam.

An embodiment that differs slightly from the exemplary embodiment shown in FIGS. 7 to 13 differs from the latter only by the fact that during the change from the switching state "1" (FIG. 9) to the switching state "2" (FIG. 10), the ink applicator rollers 3 and 4 are lifted first, and during the change from the switching state "2" to the switching state "3" (FIG. 11), the ink applicator rollers 1 and 2 are then lifted off the plate cylinder 6. The switching state "2" of this alternative embodiment, with the ink applicator rollers 1 and 2 in contact with the printing form or plate, in this case, corresponds to the short or anilox inking unit mode of operation. In the non-illustrated alternative embodiment, in the switching state "2", those ink applicator rollers 3 and 4 are thrown off the form or plate cylinder, which are also thrown off in the switching state "4", and those ink applicator rollers 1 and 2 are thrown onto the form or plate cylinder, which are also thrown onto the plate cylinder 6 in the switching state "4".

By comparison, in the exemplary embodiment shown, in the switching state "4", those ink applicator rollers 1 and 2 are thrown onto the form or plate cylinder 6, which are not thrown on in the switching state "2", and those ink applicator rollers 3 and 4 are thrown off, which are thrown on in the switching state "2".

We claim:

1. An inking unit in a printing machine having a printing form cylinder, the inking unit comprising:

at least one ink applicator roller group having a plurality of ink applicator rollers;

at least one other ink applicator roller separate from said at least one ink applicator roller group;

a throw-off device for throwing said plurality of ink applicator rollers off the printing form cylinder;

said throw-off device including a roller throw-off cam rotatably mounted and rotatable into a first rotational position of said roller throw-off cam and into a second rotational position of said roller throw-off cam, and said throw-off device including at least two operating cylinders driven by a pressurized fluid;

said at least two operating cylinders disposed in one of tandem and series and connected to said roller throw-off cam for rotating said roller throw-off cam selectively into said first rotational position and into said second rotational position; and said roller throw-off cam being contoured for retaining both said plurality of ink applicator rollers and said at least one other ink applicator roller in contact with the printing form cylinder in said first rotational position, and for throwing said plurality of ink applicator rollers off the printing form cylinder and retaining said at least one other ink applicator roller in contact with the printing form cylinder in said second rotational position.

2. The inking unit according to claim 1, including:

a further ink applicator roller group having a plurality of ink applicator rollers including said at least one other ink applicator roller and a further ink applicator roller;

said roller throw-off cam being contoured for retaining both said at least one other ink applicator roller and said further ink applicator roller in contact with the printing form cylinder in said second rotational position.

3. The inking unit according to claim 2, wherein, as viewed in a direction of rotation of the printing form cylinder, said at least one other ink applicator roller is a first-position ink applicator roller and said further ink applicator roller is a second-position ink applicator roller.

4. The inking unit according to claim 2, wherein said roller throw-off cam is rotatable into a third rotational position of said roller throw-off cam and is contoured for retaining both said plurality of ink applicator rollers of said at least one other ink applicator roller group and said plurality of ink applicator rollers of said further ink applicator roller group in contact with the printing form cylinder in said third rotational position.

5. The inking unit according to claim 1, wherein said at least one ink applicator roller, as viewed in a direction of rotation of the printing form cylinder, is a first-position ink applicator roller; said plurality of ink applicator rollers of said at least one ink applicator roller group include, as viewed in said direction of rotation of the printing form cylinder, a second-position ink applicator roller and a third-position ink applicator roller; and said roller throw-off cam is contoured for retaining only said first-position ink applicator roller in contact with the printing form cylinder and for throwing both said second-position ink applicator roller and said third-position ink applicator roller off the printing form cylinder in said second rotational position.

6. The inking unit according to claim 5, wherein said plurality of ink applicator rollers of said at least one ink applicator roller group include, as viewed in said direction of rotation of the printing form cylinder, a fourth-position ink applicator roller; and said roller throw-off cam is contoured for also throwing said fourth-position ink applicator roller off the printing form cylinder in said second rotational position.

7. The inking unit according to claim 1, wherein said operating cylinders are formed as one structural unit having a tandem cylinder.

8. The inking unit according to claim 1, wherein said roller throw-off cam is rotatably mounted coaxially with the printing form cylinder.

9. A printing machine, comprising:

a printing form cylinder; and an inking unit, said inking unit including:

at least one ink applicator roller group having a plurality of ink applicator rollers;

at least one other ink applicator roller separate from said at least one ink applicator roller group;

a throw-off device for throwing said plurality of ink applicator rollers off the printing form cylinder;

said throw-off device including a roller throw-off cam rotatably mounted and rotatable into a first rotational position of said roller throw-off cam and into a second rotational position of said roller throw-off cam, and said throw-off device including at least two operating cylinders driven by a pressurized fluid;

said at least two operating cylinders disposed in one of tandem and series and connected to said roller throw-off cam for rotating said roller throw-off cam selectively into said first rotational position and into said second rotational position; and said roller throw-off cam being contoured for retaining both said plurality of ink applicator rollers and said at least one other ink applicator roller in contact with the printing form cylinder in said first rotational position, and for throwing said plurality of ink applicator rollers off the printing form cylinder and retaining said at least one other ink applicator roller in contact with the printing form cylinder in said second rotational position.

* * * * *